United States Patent [19]

Sullivan

[11] Patent Number: 4,642,058

[45] Date of Patent: Feb. 10, 1987

[54] HYDRAULIC SYSTEM FOR MARINE PROPULSION DEVICES

[75] Inventor: Donald K. Sullivan, Waukegan, Ill.

[73] Assignee: Outboard Marine Corporation, Waukegan, Ill.

[21] Appl. No.: 731,159

[22] Filed: May 6, 1985

[51] Int. Cl.[4] ..... B63H 5/12

[52] U.S. Cl. ..... 440/61; 440/53; 440/57

[58] Field of Search ..... 440/53, 57, 61, 56

[56] References Cited

U.S. PATENT DOCUMENTS

| | | | |
|---|---|---|---|
| 3,186,375 | 6/1965 | Cass | 440/61 X |
| 3,434,449 | 3/1969 | North | 440/56 |
| 3,577,953 | 5/1971 | Braun | 440/61 X |
| 3,654,889 | 4/1972 | Bergstedt | 440/57 X |
| 3,834,345 | 9/1974 | Hager et al. | 440/57 X |
| 3,915,111 | 10/1975 | Buddrus | 440/61 X |
| 3,999,502 | 12/1976 | Mayer | 440/61 X |
| 4,052,952 | 10/1977 | Hale et al. | 440/61 X |
| 4,325,700 | 4/1982 | Kern | 440/61 X |
| 4,449,945 | 5/1984 | Ferguson | 440/61 X |

FOREIGN PATENT DOCUMENTS 1474045 5/1977 United Kingdom .

*Primary Examiner*—Sherman D. Basinger
*Assistant Examiner*—Paul E. Salmon
*Attorney, Agent, or Firm*—Michael, Best & Friedrich

[57] ABSTRACT

A marine propulsion device comprising a mounting bracket adapted to be fixedly attached to the transom of a boat and having therein an opening, a propulsion unit pivotally connected to the mounting bracket for pivotal movement relative to the mounting bracket, a hydraulic cylinder/piston assembly connected between the mounting bracket and the propulsion unit for effecting pivotal movement of the propulsion unit relative to the mounting bracket, a manifold fixedly attached to the mounting bracket adjacent the opening, the manifold being adapted to be connected to a source of hydraulic fluid inside the boat, and a fluid line communicating between the manifold and the hydraulic cylinder/piston assembly for supplying hydraulic fluid to the cylinder/-piston assembly.

11 Claims, 8 Drawing Figures

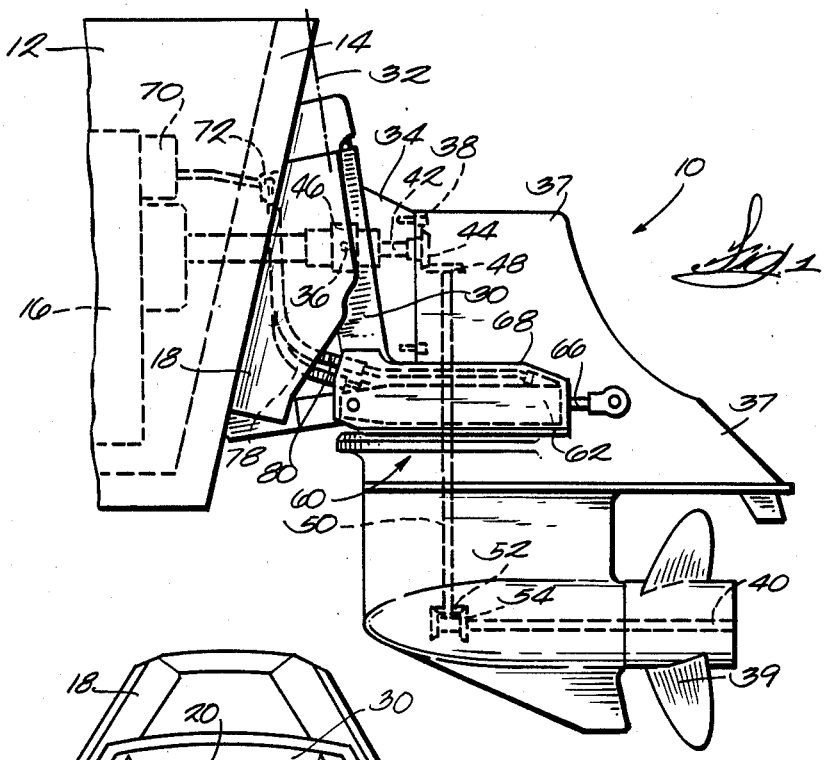
Fig. 1
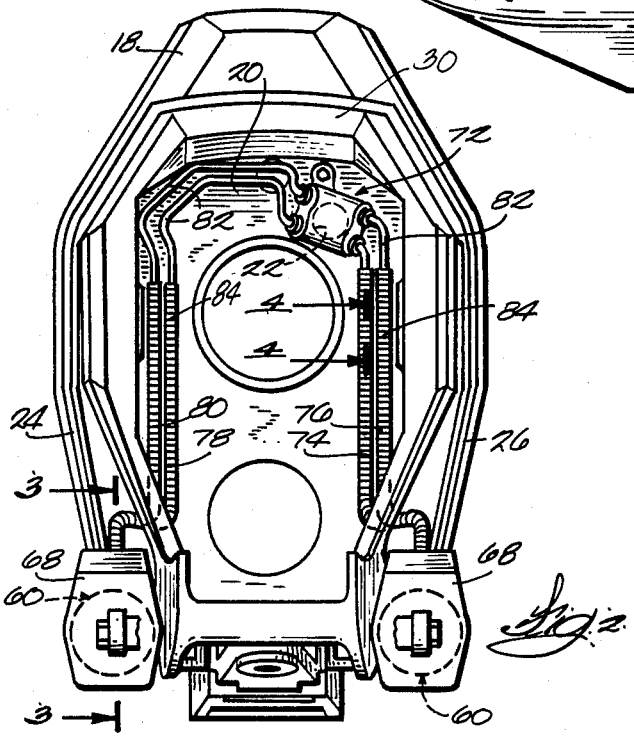
Fig. 2
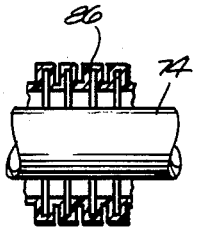
Fig. 4
Fig. 3
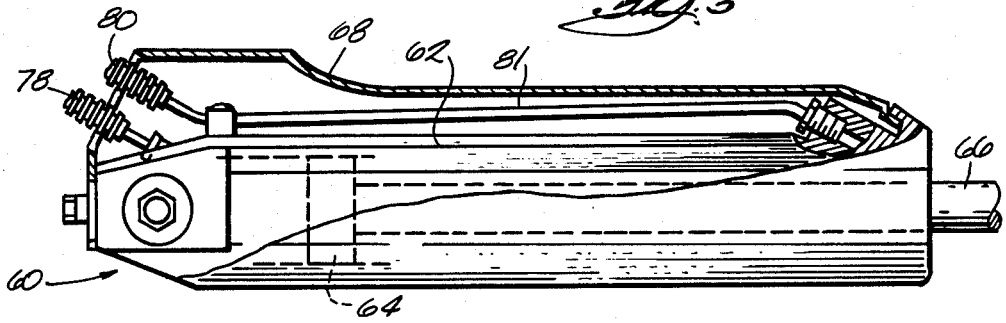

HYDRAULIC SYSTEM FOR MARINE PROPULSION DEVICES

RELATED APPLICATION

Attention is directed to Bland U.S. patent application Ser. No. 731,160, filed concurrently herewith and assigned to the assignee of this application.

BACKGROUND OF THE INVENTION

The invention relates to hydraulic systems for marine propulsion devices, and, more particularly, to means for supplying hydraulic fluid from a source of fluid inside a boat to hydraulic cylinder/piston assemblies located externally of the boat.

In marine propulsion devices, it is common to have hydraulic cylinder/piston assemblies located externally of the boat for effecting pivotal movement of the propulsion unit relative to its mounting bracket. For example, in marine propulsion devices of the stern drive or inboard/outboard type, it is common to have hydraulic cylinder/piston assemblies connected between the gimbal ring and the propulsion unit for effecting tilting movement of the propulsion unit relative to the gimbal ring. In other types of marine propulsion devices, such as outboard motors, it is known to have hydraulic cylinder/piston assemblies connected between the mounting bracket and the propulsion unit for effecting steering and/or tilting movement of the propulsion unit relative to the mounting bracket.

In many of these marine propulsion devices having hydraulic assemblies located externally of the boat, means are provided for supplying hydraulic fluid to the hydraulic assemblies from a source of fluid inside the boat. Such means typically include hydraulic lines extending from inside the boat to the hydraulic assemblies. This presents several problems.

One problem is whether to run the hydraulic lines over the transom or through the transom and, if through the transom, how to seal the opening through which the hydraulic lines pass.

Another problem, present in marine propulsion devices having two cooperating hydraulic assemblies, is how to supply hydraulic fluid simultaneously to the two assemblies.

Another problem is how to protect the portions of the hydraulic lines extending externally of the transom.

One means for supplying hydraulic fluid simultaneously to a pair of hydraulic assemblies is disclosed in U.S. Pat. No. 4,052,952, issued Oct. 11, 1977. Hale discloses a hydraulic manifold positioned between a pair of tilt/trim cylinders for supplying hydraulic fluid simultaneously to the cylinders. The manifold pivots with the cylinders relative to the mounting bracket and is not fixed to the transom or to the mounting bracket.

Various means have been devised for routing hydraulic lines over or through a boat transom. Some of these means are disclosed in the patents cited below.

Attention is directed to the following U.S. patents which disclose hydraulic systems for marine propulsion devices:

Kern, U.S. Pat. No. 4,325,700, May 20, 1982
Mayer, U.S. Pat. No. 3,999,502, Dec. 28, 1976
Ferguson, U.S. Pat. No. 4,449,945, May 22, 1984
Braun, U.S. Pat. No. 3,577,953, May 11, 1971
Buddrus, U.S. Pat. No. 3,915,111, Oct. 28, 1975

Attention is also directed to Beavers U.S. Pat. No. 3,570,534, issued Mar. 16, 1971, which discloses a hydraulic manifold.

SUMMARY OF THE INVENTION

The invention provides a marine propulsion device comprising a mounting bracket adapted to be fixedly attached to the transom of a boat and having therein an opening, a propulsion unit pivotally connected to the mounting bracket for pivotal movement relative to the mounting bracket, a hydraulic cylinder/piston assembly connected between the mounting bracket and the propulsion unit for effecting pivotal movement of the propulsion unit relative to the mounting bracket, a manifold fixedly attached to the mounting bracket adjacent the opening, the manifold being adapted to be connected to a source of hydraulic fluid inside the boat, and fluid line means communicating between the manifold and the hydraulic cylinder/piston assembly for supplying hydrauilc fluid to the cylinder/piston assembly.

In one embodiment, the manifold is mounted in the opening in the mounting bracket.

In one embodiment, the marine propulsion device further comprises means for sealing the opening around the manifold so as to substantially prevent water from passing through the opening.

In one embodiment, the marine propulsion device further comprises second fluid line means extending through the opening in the mounting bracket and having one end adapted to communicate with the source of fluid, and an opposite end communicating with the manifold.

In one embodiment, the fluid line means includes a pair of hydraulic lines.

In one embodiment, the hydraulic cylinder/piston assembly includes a cylinder having a forward end and a rearward end, and the pair of hydraulic lines communicates with the cylinder, one of the hydraulic lines being connected to the forward end of the cylinder, and the other of the hydraulic lines being connected to the rearward end of the cylinder.

In one embodiment, the second fluid line means includes a second pair of hydraulic lines.

The invention also provides a marine propulsion device comprising a gimbal housing adapted to be fixedly attached to the transom of a boat and having therein an opening, a gimbal ring pivotally connected to the gimbal housing for pivotal movement relative to the gimbal housing about a generally vertical steering axis, a propulsion unit pivotally connected to the gimbal ring for pivotal movement relative to the gimbal ring about a generally horizontal tilt axis, and for pivotal movement with the gimbal ring about the steering axis, a first hydraulic cylinder/piston assembly connected between one side of the gimbal ring and the propulsion unit for effecting pivotal movement of the propulsion unit relative to the gimbal ring, the first assembly including a first cylinder having a forward end and a rearward end, a second hydraulic cylinder/piston assembly connected between the other side of the gimbal ring and the propulsion unit for effecting pivotal movement of the propulsion unit relative to the gimbal ring, the second assembly including a second cylinder having a forward end and a rearward end, a manifold fixedly attached to the gimbal housing adjacent the opening and being adapted to communicate with a source of hydraulic fluid inside the boat, a first pair of hydraulic lines communicating between the manifold and the first cylinder, one of the hydraulic lines of the first pair being connected to the forward end of the first cylinder, and the other of the hydraulic lines of the first pair being connected to the rearward end of the first cylinder, and a second pair of hydraulic lines communicating between the manifold and the second cylinder, one of the hydraulic lines of the second pair being connected to the forward end of the second cylinder, and the other of the hydraulic lines of the second pair being connected to the rearward end of the second cylinder.

The invention also provides a marine propulsion device comprising a gimbal housing adapted to be fixedly attached to the transom of a boat and having therein an opening, a gimbal ring pivotally connected to the gimbal housing for pivotal movement relative to the gimbal housing about a generally vertical steering axis, a propulsion unit pivotally connected to the gimbal ring for pivotal movement relative to the gimbal ring about a generally horizontal tilt axis, and for pivotal movement with the gimbal ring about the steering axis, a first hydraulic cylinder/piston assembly connected between one side of the gimbal ring and the propulsion unit for effecting pivotal movement of the propulsion unit relative to the gimbal ring, the first assembly including a first cylinder having a forward end connected to the gimbal ring, and a rearward end, a first piston slidably received in the first cylinder and dividing the first cylinder into forward and rearward pressure chambers, and a first piston rod having an inner end fixedly attached to the first piston, and an outer end extending outwardly of the rearward end of the first cylinder and being connected to the propulsion unit, a second hydraulic cylinder piston assembly connected between the other side of the gimbal ring and the propulsion unit for effecting pivotal movement of the propulsion unit relative to the gimbal ring, the second assembly including a second cylinder having a forward end connected to the gimbal ring, and a rearward end, a second piston slidably received in the second cylinder and dividing the second cylinder into forward and rearward pressure chambers, and a second piston rod having an inner end fixedly attached to the second piston, and an outer end extending outwardly of the rearward end of the second cylinder and being connected to the propulsion unit, a manifold fixedly attached to the gimbal housing in the opening and including a first front port and a second front port both communicating with a first supply/return port, and a first rear port and a second rear port both communicating with a second supply/return port, means for sealing the opening around the manifold so as to substantially prevent water from passing through the opening, a first pair of hydraulic lines communicating between the manifold and the first cylinder, one of the hydraulic lines of the first pair communicating between the first front port and the forward pressure chamber of the first cylinder, and the other of the hydraulic lines of the first pair communicating between the first rear port and the rearward pressure chamber of the first cylinder, a second pair of hydraulic lines communicating between the manifold and the second cylinder, one of the hydraulic lines of the second pair communicating between the second front port and the forward pressure chamber of the second cylinder, and the other of the hydraulic lines of the second pair communicating between the second rear port and the rearward pressure chamber of the second cylinder, and a source of hydraulic fluid including means for selectively and alternatively supplying hydraulic fluid to the first supply/return port and to the second supply/return port, whereby the supplying of hydraulic fluid to the first supply/return port causes the supplying of hydraulic fluid to the forward pressure chambers of the first and second cylinders, and the supplying of hydraulic fluid to the second supply/return port causes the supplying of hydraulic fluid to the rearward pressure chambers of the first and second cylinders.

A principal feature of the invention is the provision of marine propulsion device comprising a manifold fixedly attached to the mounting bracket adjacent an opening in the mounting bracket, the manifold being adapted to be connected to a source of hydraulic fluid inside the boat, and conduit means communicating between the manifold and a pair of hydraulic cylinders/piston assemblies connected between the mounting bracket and the propulsion unit for effecting pivotal movement of the propulsion unit relative to the mounting bracket. In the preferred embodiment, the manifold is mounted in the opening in the mounting bracket, and the marine propulsion device further comprises means for sealing the opening around the manifold so as to substantially prevent water from passing through the opening. This solves both the problem of how to pass the hydraulic lines through the transom, and the problem of how to supply hydraulic fluid simultaneously to both hydraulic cylinder/piston assemblies.

Other features and advantages of the invention will become apparent to those skilled in the art upon review of the following detailed description, claims, and drawings.

DESCRIPTION OF THE DRAWINGS

FIG. 1 is a side elevational view of a marine propulsion device embodying the invention.

FIG. 2 is an end view of the marine propulsion device with the pivot housing and propulsion unit removed.

FIG. 3 is a cross-sectional view taken along line 3—3 in FIG. 2.

FIG. 4 is a cross-sectional veiw taken along line 4—4 in FIG. 2.

Figure 5:
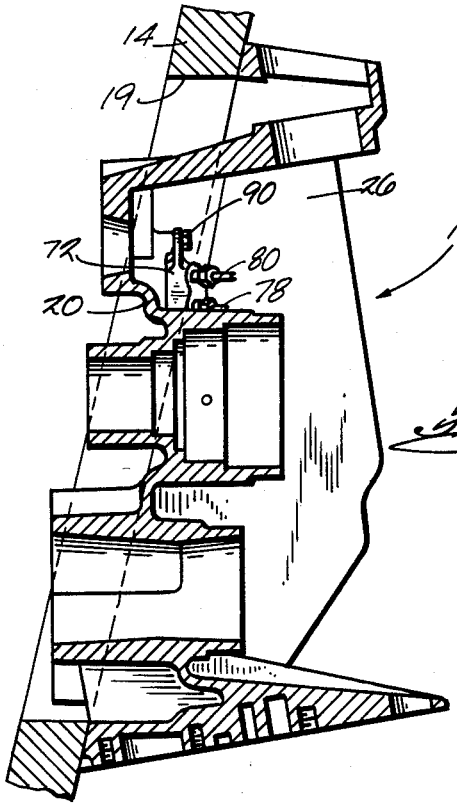
FIG. 5 is a vertical cross-sectional view of the gimbal housing.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in the drawings is a marine propulsion device 10 mounted on a boat 12 having a transom 14. In the preferred embodiment, the marine propulsion device 10 is of the stern drive or inboard/outboard type. However, the invention can be embodied in other types of marine propulsion devices, such as in outboard motors. Furthermore, while the marine propulsion device of the preferred embodiment incudes a hydraulic assembly for tilting the propulsion unit, it should be understood that the invention is applicable to hydraulic assemblies for steering the propulsion unit.

As best shown in FIG. 1, the marine propulsion device 10 comprises an engine 16 securely mounted on the boat frame by suitable means such as rubber mounts (not shown). The marine propulsion device 10 also comprises a mounting bracket or gimbal housing 18 mounted on the outer surface of the boat transom 14 and fixedly attached to the boat transom 14. The gimbal housing 18 can be attached to the boat transom 14 by any suitable means, such as by bolts extending through the transom 14.

In the preferred embodiment, as best shown in FIG. 5, the gimbal housing 18 is sealed to the transom 14 and includes a forward portion extending through an opening 19 in the transom 14. This portion of the gimbal housing 18 includes an end plate 20 generally aligned with the transom and having an upper end, an opening 22 adjacent the upper end, opposite sides, and a rear surface. In the illustrated construction, the end plate 20 is generally vertical. The gimbal housing 18 also includes a first or left (as viewed in FIG. 2) generaly vertical side member 24 extending rearwardly from the left side of the end plate 20, and a second or right generally vertical side member 26 extending rearwardly from the right side of the end plate 20.

The marine propulsion device 10 also comprises a gimbal ring 30 connected to the gimbal housing 18 for pivotal movement relative to the gimbal housing 18 about a generally vertical steering axis 32, and a pivot housing 34 connected to the gimbal ring 30 for pivotal movement relative to the gimbal ring 30 about a generally horizontal tilt axis 36. Such a construction is well known in the art and will not be described in detail other than as necesary for an understanding of the invention. In the illustrated construction, the gimbal ring 30 includes spaced apart generally vertical side members, and a lower end, and the gimbal ring 30 is partially covered by the side members 24 and 26 of the gimbal housing 18.

The marine propulsion device 10 also comprises a propulsion unit 37 removably connected to the pivot housing 34 for common pivotal movement of the propulsion unit 37 with the pivot housing 34. In the illustrated construction, the propulsion unit 37 is removably connected to the pivot housing 34 by a plurality of bolts 38. The propulsion unit 37 includes a propeller 39 mounted on a propeller shaft 40, and a generally horizontal drive shaft 42 having one end removably connected to the engine 16 and an opposite end having thereon a bevel gear 44. A universal joint 46 attached to the horizontal drive shaft 42 allows pivotal movement of the drive shaft 42 with the propulsion unit 37. The bevel gear 44 drives a bevel gear 48 on the upper end of a vertical drive shaft 50. The lower end of the vertical drive shaft 50 has thereon a driving gear 52. A reversible transmission selectively clutches a pair of driven gears 54 to the propeller shaft 40 to transmit forward or reverse motion to the propeller shaft 40 from the driving gear 52.

The marine propulsion device 10 also comprises a pair of hydraulic cylinder/piston assemblies 60 pivotally connected between the gimbal housing 18 and the propulsion unit 37 for effecting pivotal movement (tilt and trim movement) of the propulsion unit 37 relative to the gimbal housing 18 and relative to the gimbal ring 30 about the tilt axis 36. In the preferred embodiment, the hydraulic cylinder/piston asemblies 60 are connected between the lower end of the gimbal ring 30 and the propulsion unit 37. The cylinder/piston assemblies 60 extend on opposite sides of the propulsion unit 37. Only one cylinder/piston assembly 60 is shown in FIG. 1. Both as shown in FIG. 2.

Preferably, each of the cylinder/piston assemblies 60 includes a cylinder 62 having an upper portion, a forward end pivotally connected to the gimbal ring 30, and a rearwad end. The cylinder/piston assemblies 60 each also include a piston 64 slidably received in the cylinder 62 for reciprical movement therein, the piston 64 dividing the cylinder 62 into forward and rearward pressure chambers. The cylinder/piston assemblies 60 also include a piston rod 66 having a forward or inner end fixedly attached to the piston 64 and extending outwardly of the rearward end of the cylinder 62, and a rearward or outer end pivotally attached to the propulsion unit 37. Increasing the pressure in the forward pressure chamber of the cylinder 62 causes the piston rod 66 to extend, thereby causing the propulsion unit 37 to tilt upwardly, and increasing the pressure in the rearward pressure chamber of the cylinder 62 causes the piston rod 66 to retract, thereby causing the propulsion unit 37 to tilt downwardly.

Each of the hydraulic cylinder/piston assemblies 60 also includes a cover member 68 over the upper portion of the cylinder 62. The reason for the cover member 68 is explained hereinafter.

The marine propulsion device 10 further comprises conduit means having one end communicating with a source of hydraulic fluid 70 inside the boat 12, and an opposite end communicating with the hydraulic cylinder/piston assemblies 60. The conduit means extends through the opening 22 in the end plate 20 in the gimbal housing 18, downwardly from the opening 22 in the end plate 20 and inwardly of the side members 24 and 26 of the gimbal housing 18 along the rear surface of the end plate 20, and rearwardly to the hydraulic cylinder/piston assemblies 60. Because of this routing of the conduit means, the portion of the conduit means extending externally of the boat 12 is exposed only between the gimbal housing 18 and the cylinders 60. The remainder of the conduit means is covered by the side members 24 and 26 of the gimbal housing 18.

In the preferred embodiment, the conduit means includes a manifold 72 fixedly attached to the rear surface of the end plate 20 adjacent the opening 22 in the end plate 20 (either in the opening 22 or slightly spaced from the opening 22), first fluid line means communicating between the manifold 72 and the hydraulic cylinder/piston assemblies 60 for supplying hydraulic fluid to the cylinder/piston assemblies 60, and second fluid line means extending through the opening 22 in the gimbal housing 18 and having one end communicating with the source of fluid 70, and an opposite end communicating with the manifold 72.

While various suitable fluid line means can be employed, in the preferred embodiment, the first fluid lines means includes a first or right pair of hydraulic lines 74 and 76 communicating between the manifold 72 and the first or right cylinder 62, the hydraulic line 74 of the right pair being connected to the forward end and the forward pressure chamber of the right cylinder 62, and the hydraulic line 76 of the right pair being connected to the rearward end and the rearward pressure chamber of the right cylinder 62. The first fluid line means also includes a second or left pair of hydraulic lines 78 and 80 communicating between the manifold 72 and the second of left cylinder 62, the hydraulic line 78 of the left pair being connected to the forward end and the forward pressure chamber of the left cylinder 62, and the hydraulic line 80 of the left pair being connected to the rearward end and the rearward pressure chamber of the left cylinder 62.

Each of the hydraulic lines 74 and 76 of the right pair extends downwardly from the manifold 72 and inwardly of the right side 26 of the gimbal housing 18 along the rear surface of the end plate 20, and rearwardly to the forward end of the right cylinder 62. The hydraulic line 74 is connected to the forward end of the right cylinder 62 in communication with the forward pressure chamber of the right cylinder 62. The hydraulic line 76 includes a rigid portion (not shown) extending along the right cylinder 62 inside the cover member 68 and connected to the rearward end of the right cylinder 62 in communication with the rearward pressure chamber. Each of the hydraulic lines 78 and 80 of the left pair extends downwardly from the manifold 72 and inwardly of the left side 24 of the gimbal housing 18 along the rear surface of the end plate 20, and rearwardly to the forward end of the left cylinder 62. The hydraulic line 78 is connected to the forward end of the left cylinder 62 in communication with the forward pressure chamber, and the hydraulic line 80 includes a rigid portion 81 extending along the left cylinder 62 inside the cover member 68 and connected to the rearward end of the left cylinder 62 in communication with the rearward pressure chamber.

In the preferred embodiment, each of the hydraulic lines 74, 76, 78 and 80 communicating between the manifold 72 and the cylinders 62 includes a rigid portion 82 communicating with the manifold 72, and a flexible portion 84 communicating between the rigid portion 82 and the respective cylinder 62. The rigid portions 82 of the hydraulic lines are best illustrated in FIG. 2. The rigid portions 82 run along the end plate 20 so that they do not interfere with the gimbal ring 30. The flexible portions 84 run down along the end plate 20 and then rearwardly outside of the gimbal ring 30. Preferably, each of the flexible portions 84 of the hydraulic lines is covered by a protective jacket 86. The protective jacket 86 extends from inside the gimbal housing 18 to inside the cover member 68 of the respective cylinder 62. A protective jacket 68 is shown in cross-section in FIG. 4.

The cover members 68 serve two purposes. First, they protect the hydraulic lines extending along the cylinders 62 to the rearward ends of the cylinders 62. Second, they hide the hydraulic lines and give the cylinders 62 a streamlined appearance.

Figure 6:
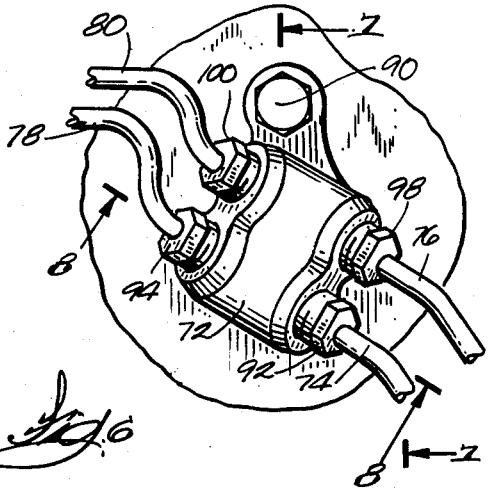
FIG. 6 is an enlarged end view of the manifold.
Figure 7:
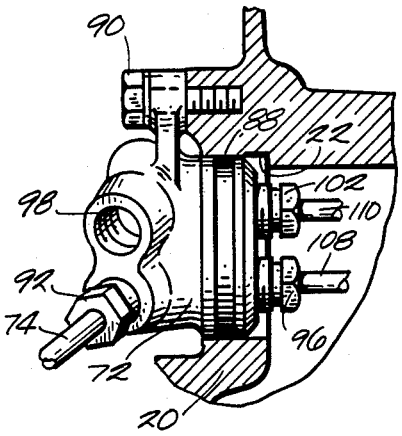
FIG. 7 is a cross-sectional view taken alone line 7—7 in FIG. 6.

In the preferred embodiment, the manifold 72 is mounted in the opening 22 in the gimbal housing 18, and the marine propulsion device 10 further comprises means for sealing the opening 22 around the manifold 72 so as to substantially prevent water from passing through the opening 22. In the illustrated construction, the best shown in FIG. 7, the sealing means includes an O-ring 88. As best shown in FIGS. 6 and 7, the manifold 72 is preferably secured to the end plate 20 of the gimbal housing 18 by one or more bolts 90 threadably received in the gimbal housing 18.

Preferably, the manifold 72 includes a first or right front port 92 and a second or left front port 94 both communicating with a first or lower supply/return port 96, and a first or right rear port 98 and a second or left rear port 100 both communicating with a second or upper supply/return port 102. The supply/return ports 96 and 102 communicate with the source of fluid 70, as explained hereinafter. The hydraulic line 74 of the right pair communicates with the right front port 92 and the hydraulic line 76 of the right pair communicates with the right rear port 98. The hydraulic line 78 of the left pair communicates with the left front port 94 and the hydraulic line 80 of the left pair communicates with the left rear port 100.

Figure 8:
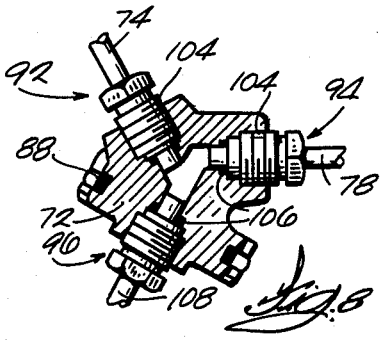
FIG. 8 is a cross-sectional view taken along line 8—8 in FIG. 6.

As best shown in FIG. 8, each of the hydraulic lines 74, 76, 78 and 80 includes an externally threaded end portion, nipple, or fitting 104 which is threaded into the manifold 72 so as to communicate with the respective manifold port. The end portions 104 are sealed to the manifold by O-rings 106.

In the preferred embodiment, the source of fluid 70 (shown schematically in FIG. 1) further includes means for selectively and alternatively supplying hydraulic fluid to the lower supply/return port 96 and to the upper supply/return port 102. Preferably, this supplying means includes a reversible pump (not shown) connected to the supply/return ports 96 and 102 by the second fluid line means communicating between the source of fluid 70 and the manifold 72. In the preferred embodiment, the second fluid line means includes a pair of hydraulic lines 108 and 110, the hydraulic line 108 communicating between the pump and the lower supply/return port 96, the hydraulic line 110 communicating between the pump and the upper supply/return port 102. The pump can be actuated by any suitable operator actuated means.

When the pump is actuated so as to supply hydraulic fluid to the lower supply/return port 96, hydraulic fluid flows out the ports 92 and 94 through lines 74 and 78 to the forward pressure chambers of both of the cylinders 62, so that the piston rods 66 extend and the propulsion unit 37 tilts upwardly. Extension of the piston rods 66 also causes flow of hydraulic fluid out of the rearward pressure chambers of the cylinders 62, through the hydraulic lines 80 and 76 to the manifold 72 through the left and right rear ports 100 and 98, and out of the manifold 72 through the upper supply/return port 102 back to the source of fluid 70. When the pump is actuated to supply hydraulic fluid to the upper supply/return port 102, hydraulic fluid flows out the ports 98 and 100 through lines 76 and 80 to the rearward pressure chambers of the cylinders 62. This causes the piston rods 66 to retract and the propulsion unit 37 to tilt downwardly. The retraction of the piston rods 66 also causes fluid to flow out of the forward pressure chambers of the cylinders 62, through the hydraulic lines 74 and 78 to the manifold 72 through the right and left front ports 92 and 94, and out of the manifold 72 through the lower/supply return port 96 and back to the source of fluid 70.

Various features of the invention are set forth in the following claims.

I claim:

1. A marine propulsion device comprising a mounting bracket adapted to be fixedly attached to the transom of a boat and having therein an opening, a propulsion unit pivotally connected to said mounting bracket for pivotal movement relative to said mounting bracket, a hydraulic cylinder/piston assembly located wholly aft of the transom and connected between said mounting bracket and said propulsion unit for effecting pivotal movement of said propulsion unit relative to said mounting bracket, a manifold fixedly attached to said mounting bracket in closing relation to said opening, said manifold being adapted to be connected to a source of hydraulic fluid inside the boat, and fluid line means communicating between said manifold and said hydraulic cylinder/piston assembly for supplying hydraulic fluid to said cylinder/piston assembly.

2. A marine propulsion device as set forth in claim 1 wherein said manifold is mounted in said opening in said mounting bracket.

3. A marine propulsion device as set forth in claim 2 and further comprising means for sealing said opening around said manifold so as to substantially prevent water from passing through said opening.

4. A marine propulsion device as set forth in claim 1 wherein said fluid line means includes a pair of hydraulic lines.

5. A marine propulsion device as set forth in claim 4 wherein said hydraulic cylinder/piston assembly includes a cylinder having a forward end and a rearward end, and wherein said pair of hydraulic lines communicate with said cylinder, one of said hydraulic lines being connected to said forward end of said cylinder, and the other of said hydraulic lines being connected to said rearward end of said cylinder.

6. A marine propulsion device as set forth in claim 1 and further comprising second fluid line means including a portion extending through said opening in said mounting bracket and having one end adapted to communicate with the source of fluid, and an opposite end communicating with said manifold.

7. A marine propulsion device as set forth in claim 6 wherein said second fluid line means includes a second pair of hydraulic lines.

8. A marine propulsion device comprising a gimbal housing adapted to be fixedly attached to the transom of a boat and having therein an opening, a gimbal ring pivotally connected to said gimbal housing for pivotal movement relative to said gimbal housing about a generally vertical steering axis, a propulsion unit pivotally connected to said gimbal ring for pivotal movement relative to said gimbal ring about a generally horizontal tilt axis, and for pivotal movement with said gimbal ring about said steering axis, a first hydraulic cylinder/piston assembly connected between one side of said gimbal ring and said propulsion unit for effecting pivotal movement of said propulsion unit relative to said gimbal ring, said first assembly including a first cylinder having a forward end and a rearward end, a second hydraulic cylinder/piston assembly connected between the other side of said gimbal ring and said propulsion unit for effecting pivotal movement of said propulsion unit relative to said gimbal ring, said second assembly including a second cylinder having a forward end and a rearward end, a manifold fixedly attached to said gimbal housing adjacent said opening and being adapted to communicate with a source of hydraulic fluid inside the boat, a first pair of hydraulic lines communicating between said manifold and said first cylinder, one of said hydraulic lines of said first pair being connected to said forward end of said first cylinder, and the other of said hydraulic lines of said first pair being connected to said rearward end of said first cylinder, and a second pair of hydraulic lines communicating between said manifold and said second cylinder, one of said hydraulic lines of said second pair being connected to said forward end of said second cylinder, and the other of said hydraulic lines of said second pair being connected to said rearward end of said second cylinder.

9. A marine propulsion device as set forth in claim 8 wherein said manifold includes a first front port and a second front port both communicating with a first supply/return port, and a first rear port and a second rear port both communicating with a second supply/return port, said first and second supply/return ports being adapted to communicate with the source of fluid, wherein said one of said hydraulic lines of said first pair communicates between said first front port and said forward end of said first cylinder, and said other of said hydraulic lines of said first pair communicates between said first rear port and said rearward end of said first cylinder, and wherein said one of said hydraulic lines of said second pair communicates between said second front port and said forward end of said second cylinder, and said other of said hydraulic lines of said second pair communicates between said second rear port and said rearward end of said second cylinder.

10. A marine propulsion device as set forth in claim 9 and further comprising a source of hydraulic fluid including means for selectively and alternatively supplying hydraulic fluid to said first supply/return port and to said second supply/return port, whereby the supplying of hydraulic fluid to said first supply/return port causes the supplying of hydraulic fluid to said forward ends of said first and second cylinders, and the supplying of hydraulic fluid to said second supply/return port causes the supplying of hydraulic fluid to said rearward ends of said first and second cylinders.

11. A marine propulsion device comprising a gimbal housing adapted to be fixedly attached to the transom of a boat and having therein an opening, a gimbal ring pivotally connected to said gimbal housing for pivotal movement relative to said gimbal housing about a generally vertical steering axis, a propulsion unit pivotally connected to said gimbal ring for pivotal movement relative to said gimbal ring about a generally horizontal tilt axis, and for pivotal movement with said gimbal ring about said steering axis, a first hydraulic cylinder/piston assembly connected between one side of said gimbal ring and said propulsion unit for effecting pivotal movement of said propulsion unit relative to said gimbal ring, said first assembly including a first cylinder having a forward end connected to said gimbal ring, and a rearward end, a first piston slidably received in said first cylinder and dividing said first cylinder into forward and rearward pressure chambers, and a first piston rod having an inner end fixedly attached to said first piston, and an outer end extending outwardly of said rearward end of said first cylinder and being connected to said propulsion unit, a second hydraulic cylinder/piston assembly connected between the other side of said gimbal ring and said propulsion unit for effecting pivotal movement of said propulsion unit relative to said gimbal ring, said second assembly including a second cylinder having a forward end connected to said gimbal ring, and a rearward end, a second piston slidably received in said second cylinder and dividing said second cylinder into forward and rearward pressure chambers, and a second piston rod having an inner end fixedly attached to said second piston, and an outer end extending outwardly of said rearward end of said second cylinder and being connected to said propulsion unit, a manifold fixedly attached to said gimbal housing in said opening and including a first front port and a second front port both communicating with a first supply/return port, and a first rear port and a second rear port both communicating with a second supply/return port, means for sealing said opening around said manifold so as to substantially prevent water from passing through said opening, a first pair of hydraulic lines communicating between said manifold and said first cylinder, one of said hydraulic lines of said first pair communicating between said first front port and said forward pressure chamber of said first cylinder, and the other of said hydraulic lines of said first pair communicating between said first rear port and said rearward pressure chamber of said first cylinder, a second pair of hydraulic lines communicating between said manifold and said second cylinder, one of said hydraulic lines of said second pair of communicating between said second front port and said forward pressure chamber of said second cylinder, and the other of said hydraulic lines of said second pair communicating between said second rear port and said rearward pressure chamber of said second cylinder, and a source of hydraulic fluid including means for selectively and alternatively supplying hydraulic fluid to said first supply/return port and to said second supply/-return port, whereby the supplying of hydraulic fluid to said first supply/return port causes the supplying of hydraulic fluid to said forward pressure chambers of said first and second cylinders, and the supplying of hydraulic fluid to said second supply/return port causes the supplying of hydraulic fluid to said rearward pressure chambers of said first and second cylinders.

* * * * *